United States Patent [19]

Harumatsu

[11] 4,394,546

[45] Jul. 19, 1983

[54] COMPOSITE SWITCH ASSEMBLY

[75] Inventor: Masatoshi Harumatsu, Tamayama, Japan

[73] Assignee: Alps Electric Co., Ltd., Tokyo, Japan

[21] Appl. No.: 310,291

[22] Filed: Oct. 9, 1981

[30] Foreign Application Priority Data

Oct. 9, 1980 [JP] Japan ..... 55/144442[U]
Nov. 5, 1980 [JP] Japan ..... 55/158019[U]

[51] Int. Cl.[3] ..... H01H 9/00

[52] U.S. Cl. ..... 200/5 R; 200/314; 273/DIG. 28

[58] Field of Search ..... 200/5 R, 4, 6 A, 7, 200/17 R, 310–317, 155 R; 273/DIG. 28

[56] References Cited

U.S. PATENT DOCUMENTS 2,841,659 7/1958 Eitel ..... 200/6 A X
3,170,995 2/1965 Mullen ..... 200/5 R
3,632,938 1/1972 Stessel ..... 200/312

FOREIGN PATENT DOCUMENTS 56-72425 6/1981 Japan .

*Primary Examiner*—A. T. Grimley
*Assistant Examiner*—Morris Ginsburg
*Attorney, Agent, or Firm*—Guy W. Shoup; Gerard F. Dunne

[57] ABSTRACT

A composite switch assembly including in a cylindrical rotary knob, four contact mechanisms in which four quadrantal push buttons are combined and arrayed into a circular form and which are operated by the four push buttoms respectively, and two contact mechanisms which are operated by turning the rotary knob clockwise and counterclockwise respectively, thereby to permit a switch arrayal and a control configuration corresponding to the moving directions of a controlled object.

13 Claims, 21 Drawing Figures

COMPOSITE SWITCH ASSEMBLY

BACKGROUND OF THE INVENTION

The present invention relates to a composite switch assembly which comprises a rotary type switch and four push-button type switches in combination.

With the recent progress of CRT displays or various remote control equipment, it has become desirable to provide a compact switch assembly which can be controlled easily and has switches for moving a controlled object vertically and horizontally as well as switches for other directional control functions.

Such a composite switch assembly with six switches is desired in, for example, a CRT display apparatus in which a controlled object such as bright spot and image on the screen, may be moved vertically and horizontally and may also be controlled to rotate clockwise or counterclockwise on a screen, or a remote-control mirror apparatus for automobiles in which mirrors disposed on a front hood may be inclined vertically and horizontally and also the mirrors in the inclined states may be controlled to turn clockwise or counterclockwise.

SUMMARY OF THE INVENTION

The present switch assembly is a novel invention for fulfilling the needs noted above, and has for its object to provide a composite switch assembly which is generally compact and which has a good controllability.

Another object of the present invention is to provide a composite switch assembly which adopts a switch array and a control configuration corresponding to the moving direction of a controlled object, thereby to permit a quick operation free from any malfunction.

Still another object of the present invention is to provide a composite switch assembly whose operating portions are internally illuminated, thereby to permit a correct and quick operation even in the dark.

Yet another object of the present invention consists in that the vertical and horizontal movements of a controlled object are executed by four push buttons, while the clockwise and counterclockwise rotations of the controlled object are executed by a rotary knob receiving and holding the four push buttons, thereby to provide a composite switch assembly which is compact and good in controllability, and that all of six contact means to be operated by the four push buttons and the rotary knob are put into an identical shape, thereby to provide a composite switch assembly which can be assembled easily.

PREFERRED EMBODIMENTS OF THE INVENTION

Hereunder, an embodiment of the present invention will be described in detail with reference to the drawings.

Figure 1:
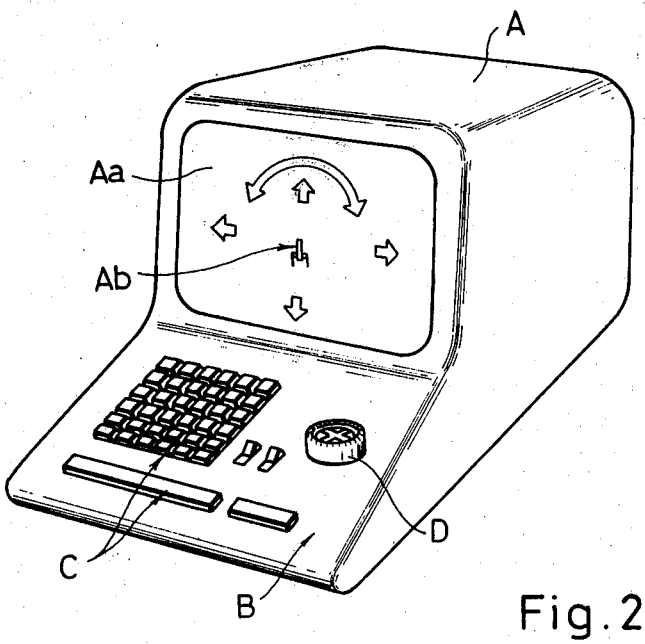
FIG. 1 is a perspective view of a CRT display apparatus which is equipped with a composite switch assembly according to the present invention.
Figure 2:
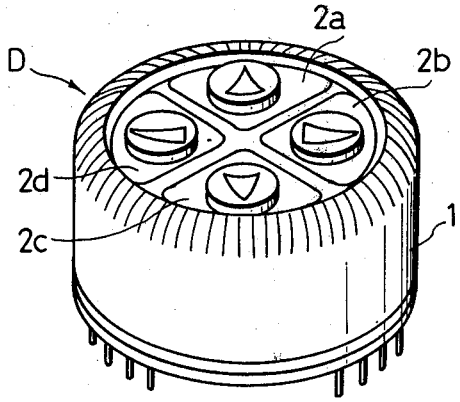
FIG. 2 is a perspective view of the composite switch assembly according to the present invention.

FIG. 1 is a perspective view showing a CRT display apparatus which is equipped with a switch assembly according to the present invention. In the figure, letter A designates the main body, in which an electronic circuit device including a printed circuit board with a microcomputer set thereon and a cathode-ray tube serving as a display device are received. Symbol A*a* indicates the display screen of the cathode-ray tube. Letter B designates an operating panel which is provided at the front of the main body A, and on which are disposed a push-button mechanism C for performing the input operations of information, etc. and a switch assembly D for moving a picture A*b*(for example, rough sketch of a rocket or car) on the display screen A*a* vertically and horizontally and turning it clockwise and counterclockwise. FIG. 2 is a perspective view showing the switch assembly D on enlarged scale. The switch assembly D has at its outer periphery a rotary knob 1 which rotates over a narrow angle. The clockwise rotation of the rotary knob 1 rotates clockwise the picture A*b* indicated on the display screen A*a* of the cathode-ray tube, while the counterclockwise rotation thereof rotates the picture A*b* counterclockwise. Four push buttons 2*a*, 2*b*, 2c and 2d are disposed inside the rotary knob 1, and arrows indicative of the moving directions of the picture are provided on the surfaces of the push buttons.

Figure 3:
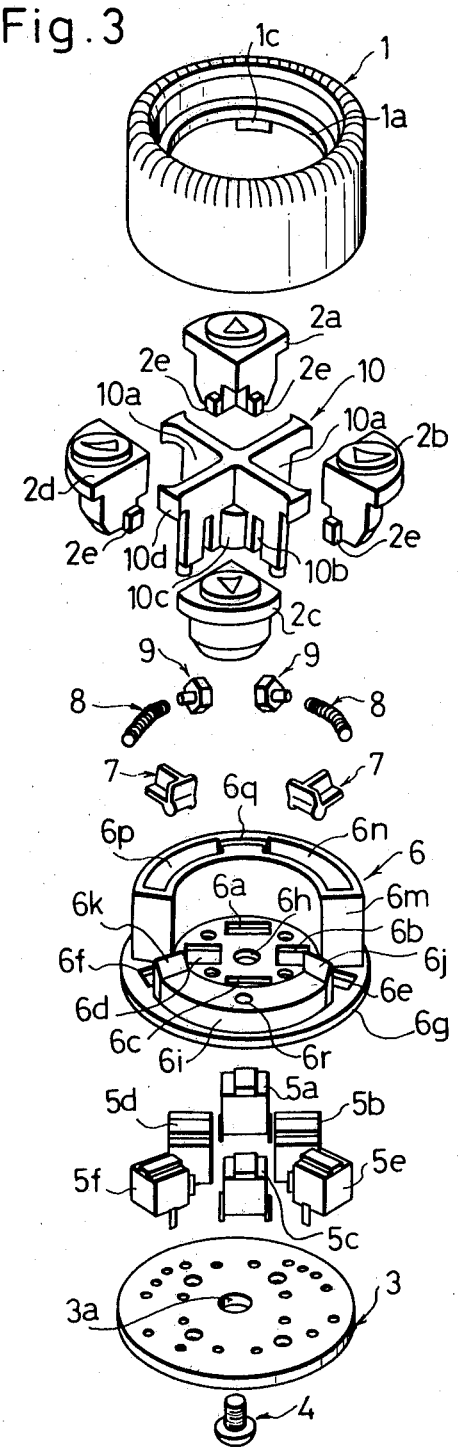
FIG. 3 is an exploded perspective view of the composite switch assembly according to the present invention.
Figure 4:
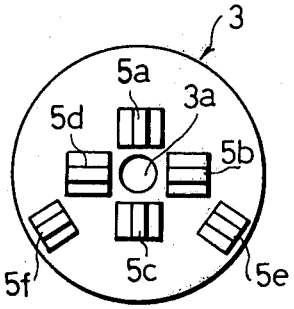
FIG. 4 is a plan view showing the state in which tactile switches are disposed in the composite switch assembly according to the present invention.
Figure 5:
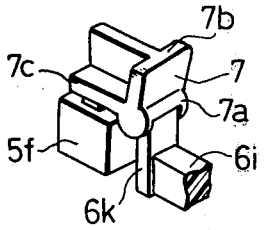
FIG. 5 is a perspective view showing the relationship between a tactile switch and a switch lever to be actuated by a rotating operation in the composite switch assembly according to the present invention.
Figure 6:
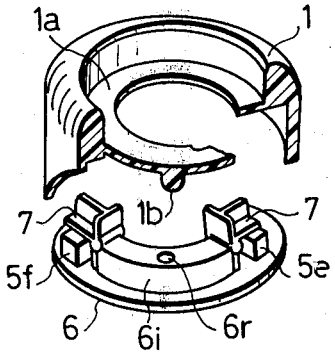
FIG. 6 is an exploded perspective view, partly simplified, showing the relationship between a rotary knob and the switch lever in the composite switch assembly according to the present invention.
Figure 7:
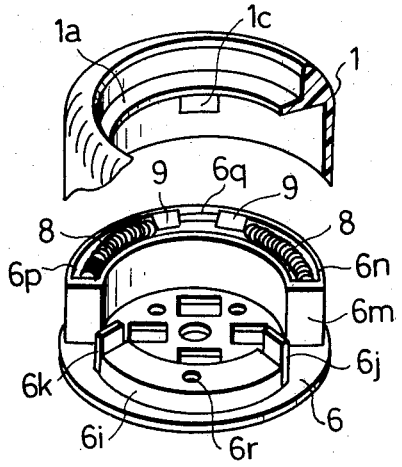
FIG. 7 is an exploded perspective view, partly simplified, showing the rotation guide mechanism of the rotary knob in the composite switch assembly according to the present invention.

FIG. 3 is a perspective view showing the switch assembly D in its disassembled state. In the figure, numeral 3 designates a switch base plate. The switch base plate 3 is centrally provided with a hole 3a through which a screw for assemblage 4 is inserted. It is also provided with holes for mounting tactile switches to be described later and holes for mounting other components. Although not shown in FIG. 3, a printed circuit and external lead-out terminals are disposed on the rear surface of the switch base plate 3. Shown at 5a to 5f are the tactile switches. The tactile switches 5a to 5d are disposed in a circular array of a common radius at intervals of substantially 90° around the hole 3a. Further, the tactile switches 5e and 5f are spaced along a circular arc having a longer radius from the hole 3a. The "tacticle switch" is a known small-sized push-button switch which includes a resilient, domed shaped contact which, when depressed, has its domed contact bent with snap action to provide a tactile sensation of its operation, and which has a push button for operation at its upper part. Numeral 6 indicates a switch base portion. The switch base portion 6 has a substrate 6g, which is provided with holes 6a, 6b, 6c, 6d, 6e and 6f for receiving the tactile switches and which is centrally provided with a hole 6h for receiving the screw 4. At an outer edge, a bed 6i is provided which is protrusively formed with support plates 6j and 6k at respective ends and which is centrally formed with a hole 6r for providing a click stop. At an outer edge opposite to the bed 6i, a rotary knob resetting bed 6m is provided. The rotary knob resetting bed 6m is formed with spring receiving grooves 6n and 6p and a narrow groove 6q coupling them. Numeral 7 indicates a switch lever. As shown in FIG. 5, the switch lever 7 has a pivotal portion 7a, an operating portion 7b and a switch operation portion 7c. The portion 7a is turnably placed on the pivotal support plate 6j or 6k. Under this state, the switch operation portion 7c abuts the push button of the tactile switch 5f and is pushed upwards by the resiliency of the domed contact inside the tactile switch. FIG. 6 illustrates the state in which the switch levers 7 are turnably placed on the support plates 6j and 6k formed at respective ends of the bed 6i. As shown in FIG. 7, respective return spring 8 and a push piece 9 are received in the corresponding spring receiving groove 6n and 6p. Numeral 10 indicates a partition plate. As clearly seen from FIG. 3, the partition plate 10 has four cruciform partition walls 10a, the lower parts of which are formed with upstanding engaging grooves 10b. The central lower part of the partition plate 10 is formed with a screw-clamping portion 10c. Each of the four push buttons 2a–2d which are respectively sectoral (quadrantal) when viewed from above is provided at the lower parts of its vertical side walls with projections 2e which slidably engage respective engaging grooves 10b. As also shown in FIGS. 6 and 7, a flange 1a is provided inside the rotary knob 1. Actuating protrusions 1b and 1c are provided at an interval of 180° on the lower side of the flange 1a.

Now, the assemblage of the switch assembly will be described.

Figure 8:
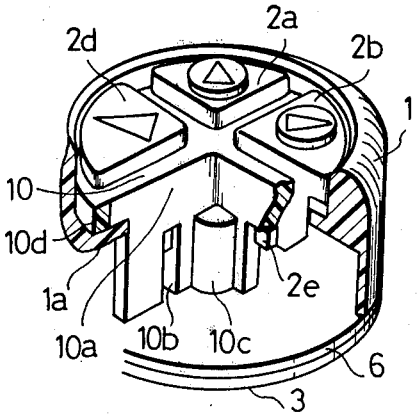
FIG. 8 is a partly cut away and simplified perspective view showing the received state of push buttons within the rotary knob in the composite switch assembly according to the present invention.
Figure 9:
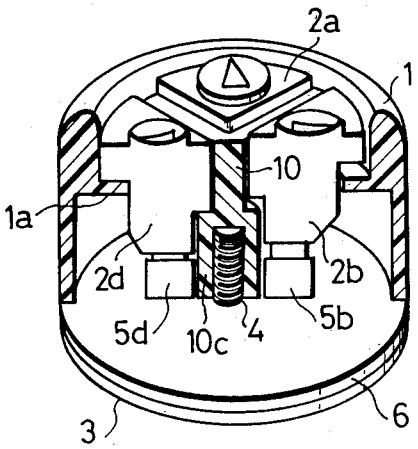
FIG. 9 is a partly cut away and simplified perspective view showing the relationship between the push button and the tactile switch in the composite switch assembly according to the present invention, FIGS. 10(*a*), 10(*b*) and 10(*c*) are simplified top plan views showing the operating states of the rotary knob in the composite switch assembly according to the present invention, FIGS. 11(*a*) and 11(*b*) are simplified developed side views for explaining the operating states of the switch lever in the composite switch assembly according to the present invention.
Figure 10A:
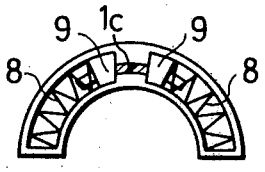
Figure 10B:
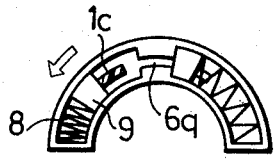
Figure 10C:
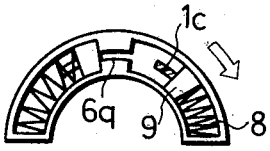
Figure 11A:
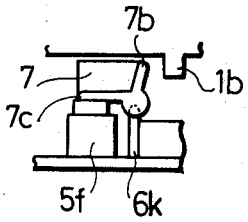
Figure 11B:
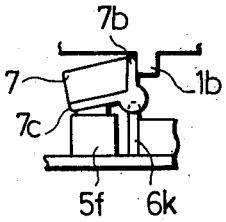

First, the six tactile switches 5a–5f are secured onto the switch base plate 3, whereupon the switch base portion 6 is placed on the switch base plate 3. At this time, the tactile switches 5a–5f penetrate through the holes 6a–6f formed in the substrate 6g, respectively. Subsequently, the switch levers 7 are placed on the support plates 6j and 6k, and the return springs 8 and the push pieces 9 are received in the spring receiving grooves 6n and 6p. Thereafter, the rotary knob 1 is fitted on the outer periphery of the switch base portion 6. At this time, the actuating protrusion 1b of the rotary knob 1 is fitted in the hole 6r, while the actuating protrusion 1c is fitted in the goove 6q. At the next step, the push buttons 2a–2d are assembled between the adjacent ones of the partition walls 10a of the partition plate 10. At this time, the projections 2e of each push button are fitted in the engaging grooves 10b. The structure in which the push buttons 2a–2d are thus assembled to the partition plate 10 is inserted into the central part of the switch base portion 6 on which the rotary knob 1 is fitted. When, under this state, the screw 4 is inserted from below the hole 3a of the switch base plate 3 and is threadably put into the screw-clamping portion 10c of the partition plate 10, this partition plate is fixed to the switch base portion 6 and the switch base plate 3. As illustrated in FIG. 8, the engaging grooves 10b of the partition plate 10 engage and fasten the projections 2e so as to prevent the push buttons 2a–2d from coming off, and the outer ends 10d of the partition plate 10 press the flange 1a of the rotary knob 1 from above so as to prevent the rotary knob 1 from coming off. Moreover, when the push button moves up and down, the projections 2e slide in the engaging grooves 10b, and hence, the movement of the push button is stable. As shown in FIG. 9, the lower ends of the respective push buttons abut on the operating portions of the tactile switches 5a–5d. Therefore, when the push button is depressed, the corresponding tactile switch is operated. Although the rotary knob 1 is prevented from coming off by means of the partition plate 10, it can turn on the peripheral surface of the switch base portion 6 a predetermined amount. When, from its neutral state shown in FIG. 10(a), the rotary knob 1 is turned in either direction, for example, a clockwise as shown in FIG. 10(c), the actuating protrusion 1b comes out of the hole 6r and the actuating protrusion 1c comes out of the groove 6q. Herein, the actuating protrusion 1c pushes the push piece 9 and consequently compresses the return spring 8. Simultaneously, the actuating protrusion 1b moves from a state in FIG. 11(a) to a position shown in FIG. 11(b) and thus pushes and turns the operating portion 7b of the switch lever 7 so as to actuate the tactile switch 5f. When the hand is released from the rotary knob 1, this rotary knob is automatically returned to the neutral state by the resilience of the return spring 8. When the rotary knob 1 is turned counterclockwise as illustrated in FIG. 10(b), the return spring 8 and the push piece 9 on the opposite side are moved, so that the tactile switch 5e on the opposite side is actuated.

The tactile switches 5a–5d are connected to circuits which move the picture upwards, downwards, leftwards and rightwards, respectively. When one of the circuits has operated, the picture moves in the corresponding direction. On the other hand, the tactile switches 5e and 5f are connected to circuits which rotate the picture clockwise and counterclockwise, respectively. When either of the circuits has operated, the picture turns in the corresponding direction.

Figure 12:
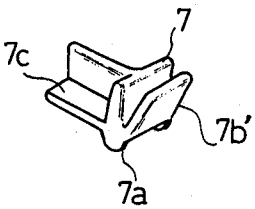
FIG. 12 is a perspective view showing another aspect of performance of the switch lever in the composite switch assembly according to the present invention, FIGS. 13(*a*), 13(*b*) and 13(*c*) are simplified developed side views for explaining the operating states of the switch lever in FIG. 12.
Figure 13A:
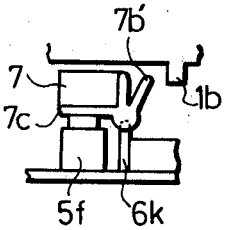
Figure 13B:
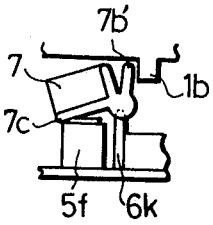
Figure 13C:
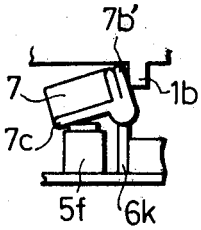

FIG. 12 is a perspective view showing another embodiment of the switch lever. In this embodiment, an operating portion 7b' is a protuberant piece capable of elastic deformation. When, from its state in FIG. 13(a), the actuating protrusion 1b moves as shown in FIGS.

13(*b*) and 13(*c*), it presses the operating portion 7*b*'. Then, the operating portion 7*b*' flexes because it is the elastic protuberant piece. Accordingly, the tactile switch 5*f* is actuated with a buffer action, and the operating touch becomes soft.

As described above in detail, according to the present invention, the six switches are unitarily assembled, so that the switch assembly is compact and easy to operate and that it is conveniently used as the operating switch assembly for conducting the six associated operations.

Since all the pressing and rotating operations are attended with the tactile sense owing to the tactile switches, the operating touch is good. In addition, the operating controllability is good in that the rotary knob automatically returns to the neutral position after its operation.

Since all the six switches used are of the same kind, the component management at the assemblage is easy.

Figure 14:
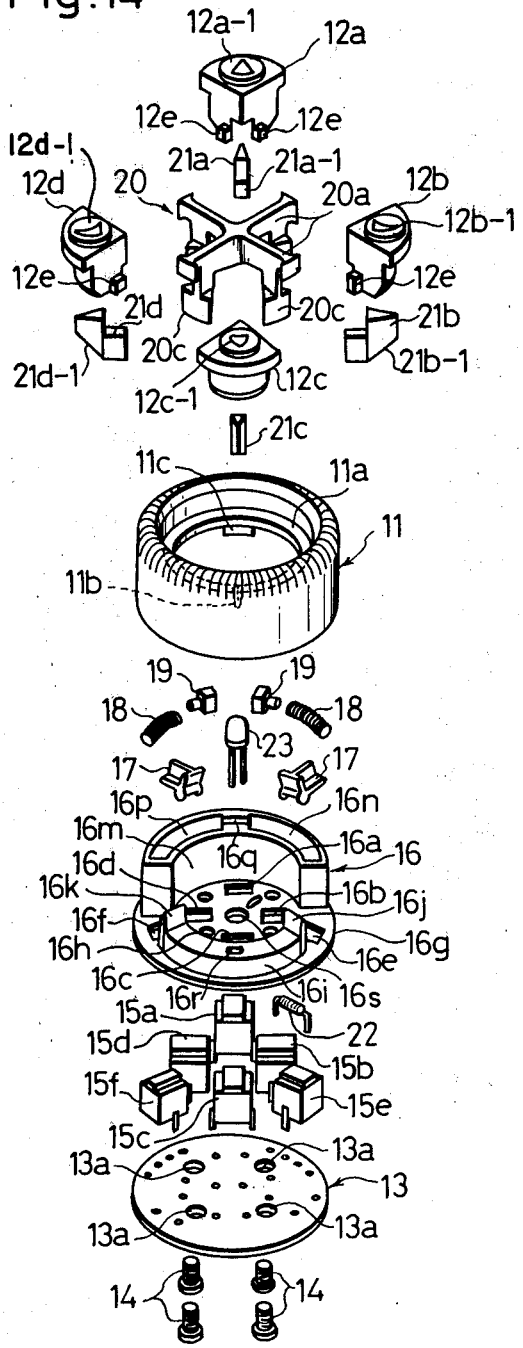
FIG. 14 is an exploded perspective view showing an embodiment in which the composite switch assembly according to the present invention is made an illuminated type one.
Figure 16:
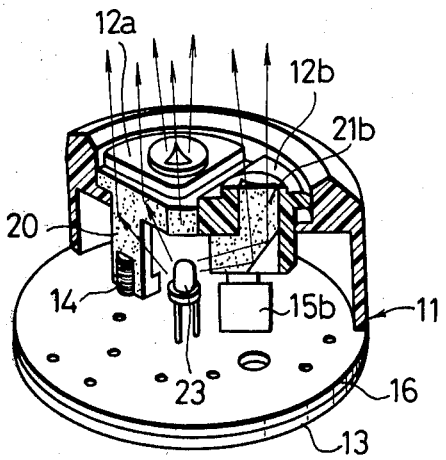
FIG. 16 is a partly cut away and simplified perspective view showing an illuminated state in the embodiment of FIG. 14.

FIGS. 14 and 16 shown an illuminated type composite switch assembly according to another embodiment of the present invention.

Figure 15:
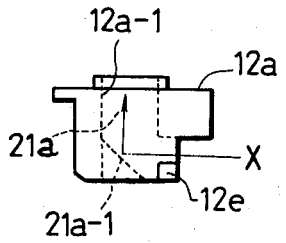
FIG. 15 is a side view of push buttons in the embodiment of FIG. 14.

Referring to the figures, numeral 11 designates a cylindrical rotary knob made of a synthetic resin and is similar to the rotary knob in the foregoing embodiment. The outer periphery of the rotary knob 11 is knurled. The inner periphery thereof is formed with an inward flange 11*a*, on the lower side of which two actuating protrusions 11*b* and 11*c* are provided at opposing positions substantially in the diametrical direction. Symbols 12*a*, 12*b*, 12*c* and 12*d* denote push buttons each of which is sectoral (quadrantal) when viewed from above. Holes 12*a*-1, 12*b*-1, 12*c*-1 and 12*d*-1 for receiving light reflector members to serve as direction marks are formed in the central parts of the respective push buttons, while projections 12*e* are formed on vertical side surfaces of each button. The light reflector members 21*a*, 21*b*, 21*c* and 21*d* are made of a transparent synthetic resin, and have light reflective faces as shown at, for example 21*a*-1, 21*b*-1, and 21*d*-1 respectively. The light reflector members 21*a*–21*d* are forcibly fitted in the holes 12*a*-1, 12*b*-1, 12*c*-1 and 12*d*-1 of the respective push buttons 12*a*–12*d*. As shown by way of example in FIG. 15, light entering in the direction of arrow X is reflected by the light reflective face 21*a*-1 and projected out through the upper surface of the push button 12*a* so as to indicate the direction mark of the push button. A portion 13 shown at the lower part of FIG. 14 is a switch base plate. The switch base plate 13 is provided with holes 13*a* through which screws 14 for assemblage are to be inserted. It is also provided with holes for mounting tactile switches, a light emitting device to be described later, a resistor for the light emitting device and other components. The tactile switches are shown at 15*a* to 15*f*. The resistor 22 for the light emitting device is mounted on the switch base plate 13. Numeral 16 indicates a switch base portion. A substrate 16*g* of the switch base portion 16 is provided with holes 16*a*, 16*b*, 16*c*, 16*d*, 16*e* and 16*f* through which the tactile switches are to be inserted. It is also provided with holes 16*h* for inserting the screws 14, a hole 16*s* for inserting the light emitting device, and a hole (not shown) for inserting the resistor 22. At an outer edge, a bed 16*i* is provided. Support plates 16*j* and 16*k* are protrusively provided at respective ends of the bed, and a hole 16*r* for providing a click stop is provided in the central part thereof. At an outer edge opposite to the bed 16*i*, a rotary knob resetting bed 16*m* is provided. The rotary knob resetting bed 16*m* is formed with spring receiving grooves 16*n* and 16*p*, and a narrow groove 16*q* coupling them. Shown at 23 is the light emitting device made of an LED (light emitting diode). Numeral 17 designates a switch lever. Numeral 18 denotes a return spring, numeral 19 a push piece, and numeral 20 a partition plate. The partition plate 20 is made of a transparent or semitransparent synthetic resin, and has four cruciform partition walls 20*a*. A screw-clamping portion 20*c* is provided at the lower end part of each of the partition walls 20*a*, while a stopper portion 20*d* abutting on the engaging edge 11*a* of the rotary knob 11 is provided at the upper end part of each of the partition walls 20*a*.

The composite switch assembly of the above construction is assembled substantially similarly to the foregoing embodiment. In the present embodiment, however, the push buttons 12*a*–12*d* are prevented from coming off in such a way that the projections 12*e* abut on the lower parts of the partition walls of the partition plate 20. In the assembled state, it is the same as in the preceding embodiment that the tactile switches are operated by depressing the corresponding push buttons 12*a*–12*d* or rotating the rotary knob 11 in the corresponding directions.

As illustrated in FIG. 16, when the light emitting device 23 in the switch assembly is turned "on", part of light emitted from the light emitting device 23 passes through the partition plate 20, and the remaining part of the light passes through the light reflector members 21*a*–21*d* received in the respective push buttons 12*a*–12*d* and reaches the surfaces of the push buttons to indicate them. Accordingly, the compact composite switch assembly whose push buttons can be readily distinguished even at nighttime or in the dark is free from malfunctions can be provided.

What is claimed is:

1. A composite switch assembly comprising:

(a) a cylindrical rotary knob;

(b) four push buttons each being substantially quadrantal when viewed from above and arrayed circularly within said rotary knob in a manner to be movable upwards and downwards a predetermined amount;

(c) a switch base plate disposed underneath said rotary knob;

(d) partition means for partitioning said four push buttons, a lower part of said partition means being fixed to said switch base plate;

(e) co-acting means provided respectively on said push buttons and said partition means for holding said push buttons in place within said rotary knob; and (f) means provided on said push buttons and said partition means for holding said rotary knob in place; and (g) contact means including six contact mechanisms disposed on said switch base plate, four of said contact mechanisms each being located under a respective one of said push buttons and adapted to be actuated by depression of the respective one of said push buttons, and the remaining two of said contact mechanisms each being respectively actuated by turning said rotary knob.

2. A composite switch assembly according to claim 1, further comprising:

(a) switch driving means protrusively formed on said rotary knob;

(b) means including two turning levers adapted to be actuated by said switch driving means and disposed over two of said contact mechanism for actuating them by turning said rotary knob;

(c) means for holding said turning levers in a manner to be turnable a predetermined amount; and (d) said contact means including a spring for normally urging each of said turning levers in one direction.

3. A composite switch assembly according to claim 2, wherein each of said turning levers includes elastically-deformable buffer means in its portion abutting on said driving means.

4. A composite switch assembly according to claim 1, wherein indications of upward, downward, leftward and rightward directions are applied on surfaces of said respective push buttons.

5. A composite switch assembly according to claim 1, wherein said six contact mechanisms have an identical configuration and each include a respective domed movable contact and respective small push button elements.

6. A composite switch assembly according to claim 1, further comprising:

(a) guide means protrusively formed in said rotary knob;

(b) holding means provided with arcuate slots for guiding said guide means, said holding means being in a fixed state relative to said switch base plate; and (c) a pair of spring means inserted in said slots and adapted to push said guide means of said rotary knob from right and left, thereby functioning to normally locate said guide means in its neutral state.

7. A composite switch assembly according to claim 1, further comprising:

(a) a flange extending inwards a predetermined amount at an upper part of said rotary knob; and (b) stopper portions provided in said respective push buttons and which abut on said flange when said push buttons are depressed.

8. A composite switch assembly according to claim 7, wherein said partition means abuts on said flange.

9. A composite switch assembly according to claim 1, further comprising:

(a) a single light emitting device disposed in a central part of said switch base plate; and (b) optical guide means received in said respective push buttons in order to guide light from said light emitting device to upper surfaces of said respective push buttons.

10. A composite switch assembly according to claim 9, wherein said partition means is formed of a light transmitting material, and the light from said light emitting device is guided to an upper surface of said partition means.

11. A composite switch assembly according to claim 2, wherein said switch driving means is formed unitarily on a flange extending inwards a predetermined amount at an upper end of said rotary knob.

12. A composite switch assembly according to claim 6, wherein said guide means is formed unitarily on a flange extending inwards a predetermined amount at an upper end of said rotary knob.

13. A composite switch assembly according to claim 11 or 12, further comprising stopper portions provided on each one of said push button and adapted to abut said flange when said push buttons are depressed.

* * * * *